United States Patent [19]

Roehrig et al.

[11] 4,402,885

[45] Sep. 6, 1983

[54] PROCESS FOR PRODUCING ATOMIZED POWDERED METAL OR ALLOY

[75] Inventors: Frederick K. Roehrig, Columbus; Dennis L. McGarry, Granville, both of Ohio

[73] Assignee: Owens-Corning Fiberglas Corporation, Toledo, Ohio

[21] Appl. No.: 373,464

[22] Filed: Apr. 30, 1982

[51] Int. Cl.[3] ..... B01J 2/02

[52] U.S. Cl. ..... 264/11; 264/12

[58] Field of Search ..... 264/11, 12

[56] References Cited

U.S. PATENT DOCUMENTS 3,719,733 3/1973 Rakestraw et al. ..... 264/12

4,264,641 4/1981 Mahoney et al. ..... 264/12

*Primary Examiner*—James R. Hall

*Attorney, Agent, or Firm*—Ronald C. Hudgens; Patrick P. Pacella

[57] ABSTRACT

A process for producing atomized, powdered metal or alloy is disclosed. Streams of molten metal or alloy are forced through orifices whose openings are so small that the surface tension of the molten metal or alloy would otherwise prevent the flow of molten metal or alloy through the orifice.

5 Claims, 1 Drawing Figure

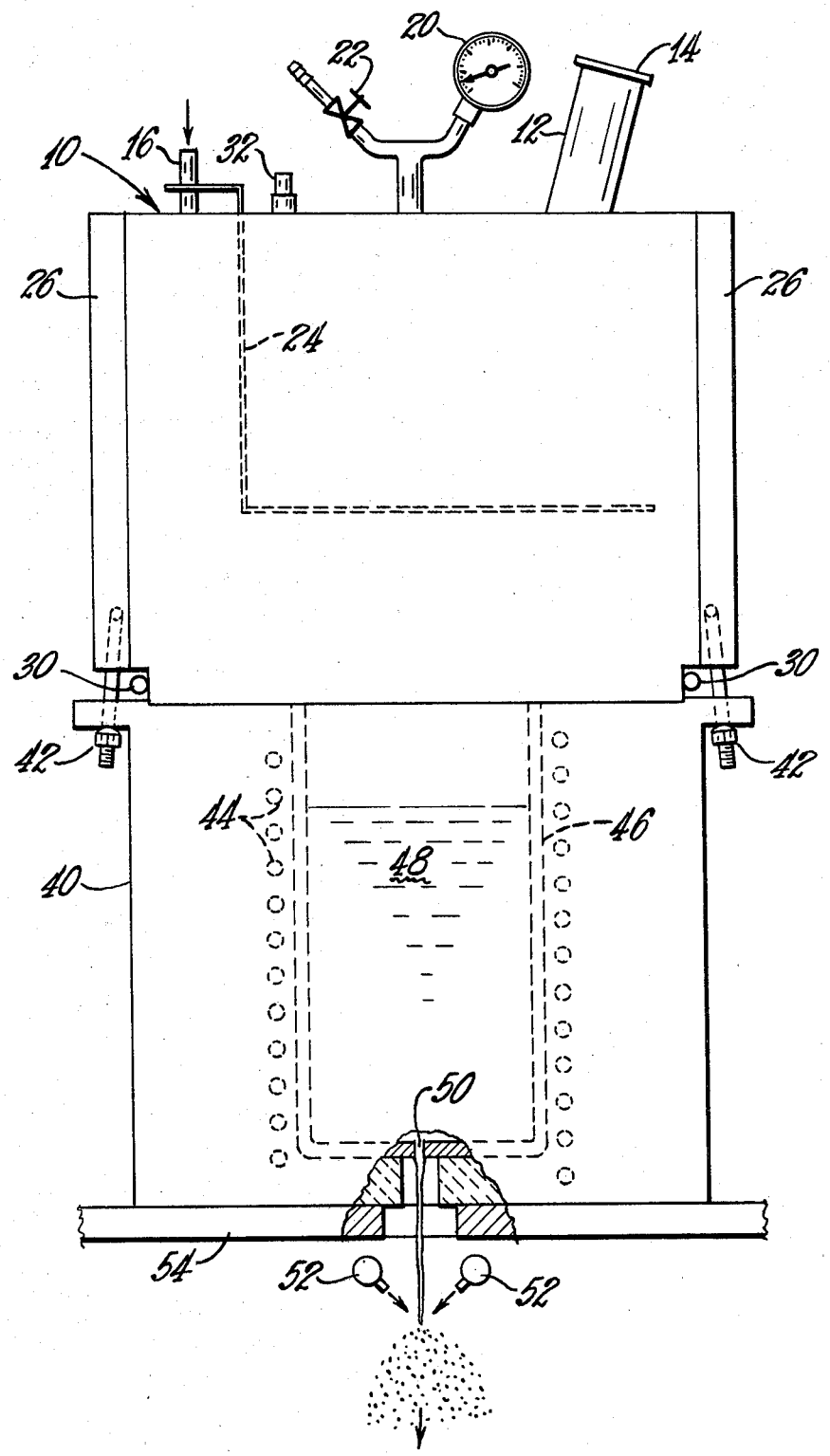
20
22
14
12
10
16
32
26
26
24
30
30
42
42
44
46
48
40
50
54
52
52

PROCESS FOR PRODUCING ATOMIZED POWDERED METAL OR ALLOY

TECHNICAL FIELD

This invention relates to the production of powder by the atomization of metal alloys.

BACKGROUND ART

One of the most exacting applications of platinum is in the production of glass fibers. Molten glass often at temperatures ranging from 1200° to 1600° C. passes through a series of orifices in a bushing made of platinum or platinum alloy. Advances in glass fiber production are demanding both larger bushings and higher operating temperatures, which, in turn, places even more of a demand on the alloy used to make the bushing.

Alloys for these operations may be produced by dispersing very small, hard particles called dispersoids into the alloys to improve the strength of their microstructure. These system are known as dispersion-strengthened metals and alloys. Dispersion strengthening is mechanical alloying which uses a high energy ball mill to achieve the intimate mechanical mixing typical of the process. An attritor mill or vibratory mill may be used.

In order to more easily mechanically alloy the metal or alloy, it is desirable to begin with a finely powdered material. One method for atomization of the metal is to impinge a stream of molten metal with a stream of a fluid such as water. The result is a finely powdered metal or alloy which may be mechanically alloyed with an appropriate despersoid.

One means for providing a stream of molten material for atomization is a container with an orifice in the bottom. This means has its limitations as there is no means for stopping the flow of molten material once processing begins. Advances have provided a stopper or plunger for controlling the flow of molten material through the orifice. The stoppers or plungers usually are made of ceramic materials. Problems exist with the ceramics in that they can permanently seal the orifice either by bumping during loading of the alloy charge or by reaction between the container and plunger if the molten material is too hot.

DISCLOSURE OF THE INVENTION

We have developed a container for providing the molten material which has an orifice whose opening is so small that surface tension prevents the flow of molten material through the orifice. We then employ an overpressure which is sufficient to force the molten material through the orifice. These means eliminate the difficulties of the prior art. The alloy charge is easily loaded into the crucible and melted. Once atomization temperature is reached, pressure is used to force the molten material through the orifice at a desired rate. Not only can the rate be easily controlled, but the flow also may be easily started and stopped in response to conditions in the atomization chamber.

BRIEF DESCRIPTION OF DRAWING

The FIGURE is a schematic drawing of means for carrying out the process of this invention.

BEST MODE OF CARRYING OUT INVENTION

The FIGURE is a schematic of the pressurization device 10 of this invention. The device consists of a pressure cap assembly 10 with a cylindrical cap 12 and a sight port 14 for measuring the temperature of the melt, a gas inlet line 16, pressure gauge 20 and bleed valve 22. A safety release valve 32 also is shown. A radiation shield 24 allows for intermittent temperature measurement of the melt in the "open" position. In the "closed" position, radiation heat losses are minimized. The external cooling fins 26 facilitate cooling of container 10 as do water cooling coils 30.

In carrying out the process of this invention, pressurizing cap assembly 10 was placed in position over a container 40 for feeding molten alloy to an atomization process. Hold down clamps 42 hold assembly 10 in place over container 40. Induction coils 44 are employed to heat crucible 46. Melt 48 exists orifice 50 where a stream of melt 48 is atomized with a gas or fluid from atomization nozzles 52. The entire apparatus rests on support structure 54.

Conveniently, the above means have been provided for illustrating the function of this invention. While such means may take the form illustrated, it may also take a variety of other forms. While any inert gas could be used for pressurizing the container, argon was preferred. We first tested the apparatus with water to verify the sealing capability of the gasket material. Gas pressure was administered forcing the water through the orifice into the atomization chamber. The next test was a full scale trial using an orifice of 0.013 inches in diameter. The pressurization system behaved as planned in that the melt stock was easily loaded into the container or crucible. The melt stock was melted and the temperature increased to the atomization temperature without any metal dripping through the orifice. Upon sealing the pressurization vehicle to the crucible and increasing the argon gas pressure to 10 psi, the liquid metal flowed out of the orifice and was atomized by conventional means. This trial clearly demonstrates the concept of using an orifice of a specified size based upon surface tension to retain a liquid metal in a crucible until ready for atomization.

The proper size of the orifice was calculated based upon the surface tension of the molten metal at or near its melting point. Table A shows some of the calculations used for surface tensions of platinum of 3,000 and 4,000 ergs per square centimeter. The pressure was computed from the metalstatic head on the orifice of radius R(cm) assuming a liquid density of nominally 21 grams per cc. The relationship between the pressure over the orifice in the orifice radius for a given surface tension value is shown in Table B. The graph can be used to predict flow and no flow behavior.

Based upon the mass, the molten metal droplet, and the size of the small strand of metal holding the droplet to the remainder of the metal, the surface tension was estimated to be about 3,300 ergs per square centimeter, which is in fairly good agreement with that from the literature. Using this value, an orifice size of about 0.013 inch in diameter was estimated for holding the liquid metal back due to its own surface tension.

In order to estimate the radius of the orifice, the following equation may be employed:

$$P=(2ST/r)$$

wherein P represents the pressure at the orifice, ST represents the surface tension of the molten metal and r represents the radius of the orifice. Typically, these variables are expressed in the following units:

P—dyns/cm$^2$

ST—ergs/cm$^2$ r—cm

Table A shows same calculations done using assumed values of 3,000 and 4,000 ergs/cm$^2$ for the surface tension. The pressure at the orifice was computed for molten platinum.

TABLE A

| ST $\frac{(ergs)}{(cm^2)}$ | r (cm) | P (dyns/cm$^2$) |
|---|---|---|
| 3,000 | .01 | $6 \times 10^5$ |
| | .02 | $3 \times 10^5$ |
| | .04 | $1.5 \times 10^5$ |
| | .08 | $7.5 \times 10^4$ |
| | .16 | $3.75 \times 10^4$ |
| | .32 | $1.88 \times 10^4$ |
| 4,000 | .01 | $8 \times 10^5$ |
| | .02 | $4 \times 10^5$ |
| | .04 | $2 \times 10^5$ |
| | .08 | $1 \times 10^5$ |
| | .16 | $5 \times 10^4$ |
| | .32 | $2.5 \times 10^4$ |

The relationship between the pressure over the orifice and the orifice radius for a given surface tension is shown in Table B. The graph can be used to rationalize flow and no flow behavior for a given molten metal alloy. The applied pressure must be greater than the above listed pressure for a given r and ST in order for flow to start.

TABLE B

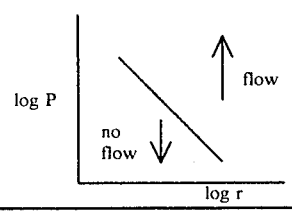

INDUSTRIAL APPLICABILITY

Preferred methods for dispersion strengthening of metals ordinarily are dependent upon powder metallurgy wherein the alloy powder should have particle sizes less than about 300 microns and preferably less than about 200 microns. The most practical and efficient method for producing alloy powder is by atomization of molten metal wherein a plurality of liquid streams (water) or nitrogen gas are sprayed from nozzles to impinge upon a centrally disposed molten metal. The high pressure streams intersect the molten metal to provide atomized alloy metal particles. The atomization process typically produces a size range of small particles. The larger particles above about 180 microns are recycled into the molten metal and reatomized.

Conventional practices in the powder metallurgy industry include the formation of atomized metal particulates by gas atomization or water atomization processes. These conventional atomization techniques typically include the following steps:

(1) the charging of virgin, or prealloy metals, in solid forms into a melting furnace;

(2) transferring the formulated molten metal to a holding furnace for further homogenization and for temperature stabilization;

(3) flowing by virtue of the "head" of molten metal a liquid stream of the molten metal through a circular opening of a ceramic face place fitted in the bottom of the holding furnace, the liquid stream being "formed" as said stream is pushed through the circular opening;

(4) disintegrating the stream of liquid metal on exit from the annular nozzle by a stream of pressurized water, the other being typically pressurized to several hundred psi;

(5) collecting the atomized, disintegrated, or particulated metal (in hot powder form) which is carried by the atomizing water mass into a collection bin, the powder being air cooled in the collection bin; and (6) conveying the atomized powder from the bin to a screening device for "scalping" of oversize (unwanted) particles.

The general method described above can be modified depending upon the alloy type and particle morphology desired by utilizing an atomizing or disintegration media other than water, typical atomizing media including air, steam, nitrogen, argon, and helium inter alia. Collection media can comprise water, particularly if quenching is desired or if the atomized fluid media is other than air. Atomized powder disintegrated or collected by certain media may obviously require filtering and drying. Depending upon the requirements of a user of the present powder, the atomized product may be treated further, such as by thermal treatment in a reducing atmosphere, to minimize oxide content.

We claim:

1. A process for producing atomized powdered metal or alloy including the steps of providing a container containing molten metal or alloy;

placing the molten metal or alloy under a head of gas pressure;

flowing liquid streams of molten metal or alloy through orifices in the container whose openings are so small that the surface tension of the molten metal or alloy without the applied head of inert gas pressure would prevent the flow of molten metal or alloy through the orifices; and impinging the streams of molten metal or alloy from the openings with streams of pressurized gas or liquid to form atomized, powdered metal or alloy.

2. A process according to claim 1 having the relationship represented by the formula $$P=(2ST/r)$$

wherein P represents the pressure at the orifice, ST represents the surface tension of the molten metal or alloy and r represents the radius of the orifice.

3. A process according to claim 2 wherein the pressure at the orifice is greater than the pressure calculated for a given radius and a given surface tension.

4. A process according to claim 1 wherein the molten metal or alloy is platinum.

5. The process of claim 1, wherein the metal is platinum, the inert gas is argon at a pressure of 10 psi, and the orifices have a diameter of 0.013 inch.

* * * * *